US006772462B1

(12) United States Patent
Harrell

(10) Patent No.: US 6,772,462 B1
(45) Date of Patent: Aug. 10, 2004

(54) TILTABLE BED

(75) Inventor: Joyce Claflin Harrell, Bloomington, IN (US)

(73) Assignee: Claflin Enterprises, LLC, Bloomington, IN (US)

( * ) Notice: Subject to any disclaimer, the term of this patent is extended or adjusted under 35 U.S.C. 154(b) by 0 days.

(21) Appl. No.: 10/458,046

(22) Filed: Jun. 10, 2003

(51) Int. Cl.[7] ..... A47C 31/00
(52) U.S. Cl. ..... 5/660; 5/659
(58) Field of Search ..... 5/659, 660, 509.1, 5/610

(56) References Cited

U.S. PATENT DOCUMENTS

| | | | | | |
|---|---|---|---|---|---|
| 71,808 | A | | 12/1867 | Steinel | |
| 234,303 | A | | 11/1880 | Libby | |
| 781,328 | A | | 1/1905 | Brown | |
| 992,080 | A | | 5/1911 | Swanger | |
| 1,401,554 | A | | 12/1921 | Philips | |
| 1,429,080 | A | | 9/1922 | Kirby | |
| 3,247,528 | A | | 4/1966 | Swenson et al. | |
| 3,310,289 | A | | 3/1967 | Burke | |
| RE26,411 | E | * | 6/1968 | Alsobrook, Jr. | |
| 3,392,723 | A | * | 7/1968 | Calvin | |
| 3,667,075 | A | * | 6/1972 | Ballard et al. | 5/348 |
| 3,781,924 | A | | 1/1974 | Davis, Jr. | |
| 3,781,928 | A | | 1/1974 | Swallert | |
| 3,797,052 | A | | 3/1974 | Licina et al. | |
| 3,808,615 | A | | 5/1974 | Geary | |
| 4,118,811 | A | * | 10/1978 | Degen | 5/62 |
| 4,309,783 | A | * | 1/1982 | Cammack et al. | 5/508 |
| 4,527,298 | A | * | 7/1985 | Moulton | 5/66 |
| 4,715,073 | A | | 12/1987 | Butler | |
| 4,807,313 | A | | 2/1989 | Ryder et al. | |
| 4,819,282 | A | | 4/1989 | McArthur et al. | |
| 4,856,129 | A | * | 8/1989 | Butler | 5/62 |
| 5,205,005 | A | | 4/1993 | Merrill et al. | |
| 5,224,227 | A | | 7/1993 | McGinley | |
| 5,243,726 | A | | 9/1993 | Bisbee | |
| 5,416,939 | A | | 5/1995 | Maalouli | |
| 5,566,412 | A | | 10/1996 | Arnold | |
| 5,592,709 | A | | 1/1997 | Watkins | |
| 6,058,532 | A | | 5/2000 | Allen | |
| 6,138,305 | A | | 10/2000 | Smith | |
| 6,447,000 | B1 | * | 9/2002 | Dick et al. | 28/511 |
| 2003/0188387 | A1 | * | 10/2003 | Leventhal et al. | 5/660 |

* cited by examiner

*Primary Examiner*—Teri Pham Luu
(74) *Attorney, Agent, or Firm*—Woodard, Emhardt, Moriarty, McNett & Henry LLP

(57) ABSTRACT

A tilting bed assembly is disclosed having a horizontal base frame and second frame hinged at one end to the base frame and an inflatable bag adjacent the other end to raise and lower one end of the tilting frame relative to the base frame. A hand-held three-position switch is connected through a relay to a three-position electrically operated solenoid valve and to an air compressor to selectively raise and lower the one end of the bed at the will of the person lying in the bed. The tilting frame is rigid to avoid articulation between its ends. Alternatively, instead of an inflatable bag, an electric actuator may be provided to raise and lower one end of the tilting frame relative to the base frame. A conventional foundation is received on the second frame with a stop on the second frame to prevent it sliding off when the frame is tilted.

16 Claims, 9 Drawing Sheets

TILTABLE BED

BACKGROUND OF THE INVENTION

This invention relates generally to residential-type beds, and more particularly to apparatus adapting such beds to adjustment of the elevation of the head relative to the foot of the bed or vice versa.

For many years, hospital beds have been known to have features enabling support of the bedding in various configurations to adapt to the particular needs of a patient using the bed. Such beds are relatively heavy, complicated and expensive. Some people have chronic ailments which can be addressed by simply tilting the bedding, such as the mattress and foundation (box spring, for example) so that the entire assembly is tilted or inclined in a plane with head end at a level above the foot end at some angle or, in a few instances, with the foot end at a level above the head end. Persons who can be helped by one or the other types of inclination include those suffering from gastroesophageal reflux disease (GERD), heartburn, hiatal hernia, Barrett's esophagus, bariatric surgery, congestive heart failure, orthopnea (shortness of breath when lying supine), persons suffering from swelling of the legs, aka edema, and obstetrical patients. Some women are required to be in Trendelenberg position for some time prior to delivery. The purpose is to take pressure off of the cervix. Rather than purchase or lease a hospital bed, some people have dealt with the problem in various ways. One example is placing blocks under the legs at one end of the bed. There is a U.S. Pat. No. 5,224,227 issued Jul. 6, 1993 and which discloses specially shaped blocks for receiving the lower ends of the legs of a bed which is to be raised at one end. These approaches, while simple, can require considerable experimentation to obtain the right inclination toward the foot of the bed.

There is a type of bed having telescoping legs to place the occupant in the "head down" or Trendelenberg position, or in a "head-up," reverse Trendelenberg position. This is shown and described in U.S. Pat. No. 3,797,052 issued Mar. 19, 1974. An assembly for use with a conventional bed frame for tilting the mattress is disclosed in U.S. Pat. No. 5,243,726 issued Sep. 14, 1993. It establishes a fixed inclination of the mattress, depending upon the length of the tilt establishing braces. An adjustable inclineable bed frame assembly is disclosed in U.S. Pat. No. 5,566,412 issued Oct. 22, 1996 and which uses a lower base frame and an upper mattress frame and which can be raised or lowered as desired with a screw jack assembly. Other arrangements are disclosed in patents listed in that patent. Most, if not all, of these devices require their own structures and do not provide readily adjustable apparatus mountable in a conventional bed frame of standard size. U.S. Pat. No. 5,592,709 issued Jan. 14, 1997 discloses a transverse foundation support bar mounted on base elements to be slid on side rails of a conventional bed to adjust the angle of inclination. U.S. Pat. No. 4,715,073 issued Dec. 29, 1987 uses a power unit combined with a cam ramp to raise and lower the head end of the bed. None of these arrangements make it convenient for the occupant of the bed to adjust the inclination to the optimum angle for patient comfort while lying in the bed.

U.S. Pat. No. 6,058,532 issued May 9, 2000 discloses a combination of a motor and jack screws under one end of the bed and operable by a hand-held control to drive the electric motor to move the end of the bed up or down and stop at a desired inclination.

U.S. Pat. No. 6,138,305 discloses a bed frame insert. It uses manually operable screws to raise one end of a mattress, but it cannot be adjusted by the occupant in the bed.

Another approach to moving a mattress to an inclined attitude appears in U.S. Pat. No. 4,807,313 issued Feb. 28, 1989 and which discloses a plurality of pneumatic cells under the matress. Inflatable devices of other types have been used for raising portions of a bed. U.S. Pat. No. 3,781,928 issued Jan. 1, 1974 discloses a pneumatic system capable of raising the head end and the foot end independent of the area between the ends. U.S. Pat. No. 5,416,939 issued May 23, 1995 discloses a bed tilting apparatus using a wedge-shaped bag.

Notwithstanding the variety of devices which have been invented already, there remains a need for apparatus usable with a conventional mattress and foundation and readily mountable in a conventional bed frame or mountable on its own legs on the base frame for support above the floor to raise either the head end or the foot end of a mattress at the will and under the control of the person in the bed in an effort to obtain an inclination providing optimum possible comfort under the circumstances.

DESCRIPTION OF THE ILLUSTRATED EMBODIMENTS

Figure 1:
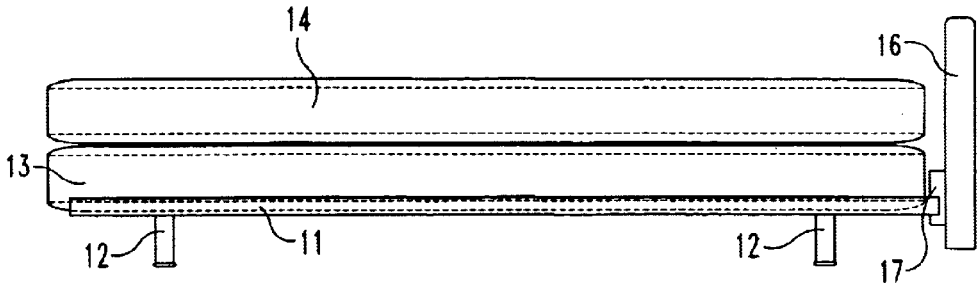
Fig. 1 (PRIOR ART)
FIG. 1 is an elevational view of a conventional queen-size bed assembly with frame, headboard, foundation and mattress set.

Referring now to the drawings in detail, FIG. 1 illustrates a conventional queen-size bed assembly including a metal frame having side rails 11, legs 12, all supporting a combination foundation unit 13 and mattress 14. A headboard 16 is mounted to plates 17 at the ends of the frame side rails. Of course, conventional metal bed frames are available with cross members foldable for packing, but which can be opened and telescoped together and clamped in a relationship enabling a horizontal spacing between the frame side members which will accept whatever width of mattress is desired. The present invention is usable with such frames as well as with other frames which are of a specified width.

Figure 2:
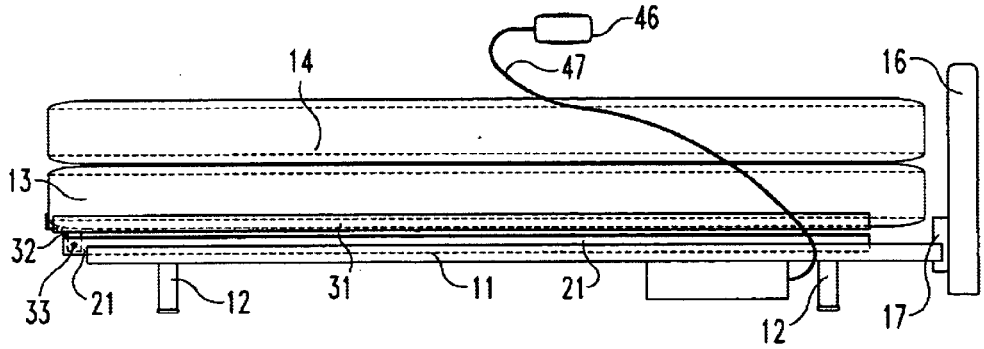
FIG. 2 is a side elevational view of the same combination but including tiltable bed features incorporated on it according to one embodiment of the present invention.
Figure 5:
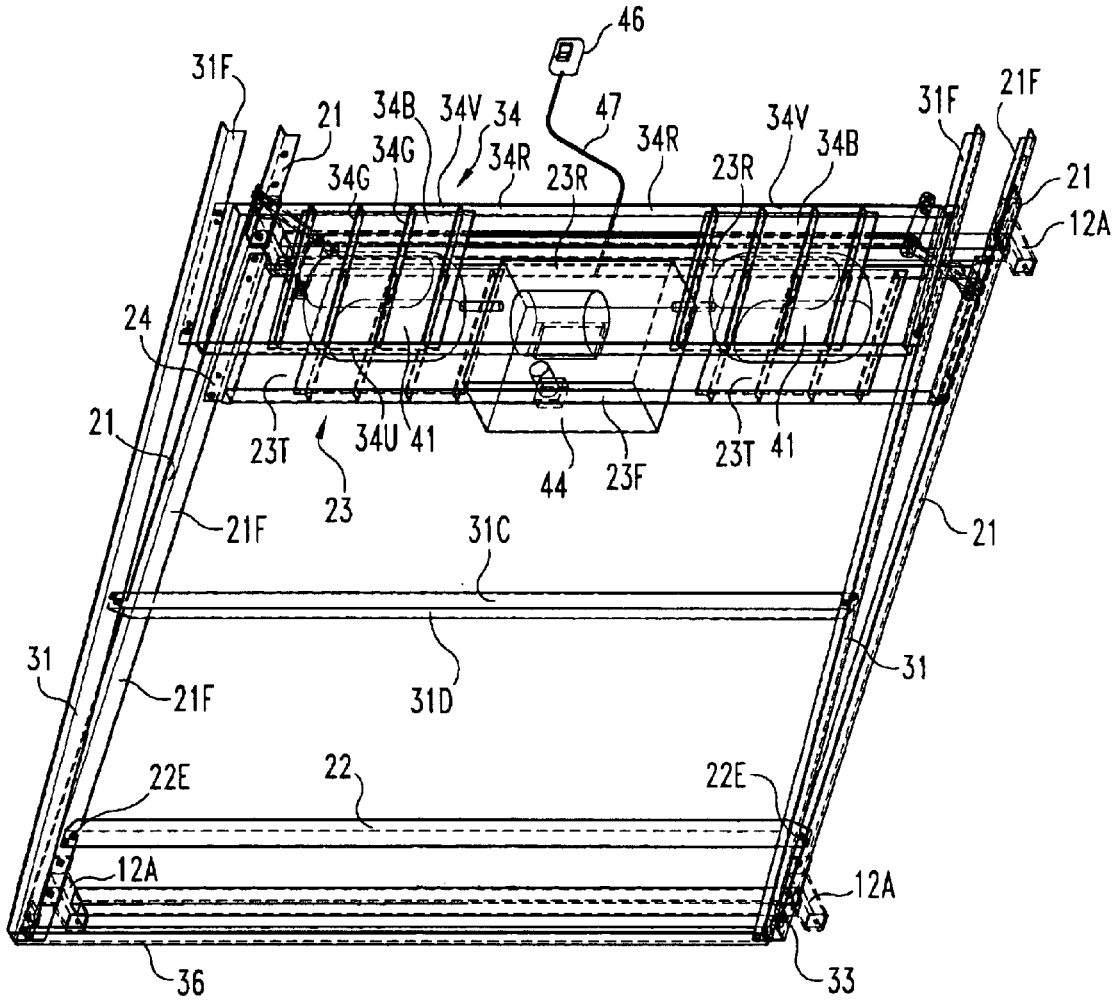
FIG. 5 is a perspective view of the tilting assembly without the foundation and mattress set.

Referring now to FIG. 2, the same bed structure is shown as is shown in FIG. 1, with the same foundation and mattress. But in this case, the tilting frame assembly is included. It includes a couple of base frame members 21 and which have an L-shaped cross section received in and supported on the side members 11 of the standard bed frame and which also have an L-shaped cross section. A tilting frame has two side members 31, which have downwardly projecting tabs 32 fixed to them and which are pivotally mounted at pins 33 to the base frame side members 21 for tilting around a horizontal axis. Structural rigidity is provided for the base frame near the pivot end by a cross member 22 (FIG. 5). Similarly, the tilting frame has a structural cross member 31C having its ends fixed to the side members 31. All of the side members of the bed frame, the tilting assembly base frame, and the tilting frame, are made of right-angle section steel rails. The same is true of cross member 22 which is fastened at both ends 22E to the in-turned horizontal flange 21F of one or the other of the base rails 21. Cross member 22 is mounted with the vertical flange standing up. In contrast, the cross member 31C is secured to the horizontal flanges 31F of rails 31 and has its vertical flange down-turned at 31D.

Figure 6:
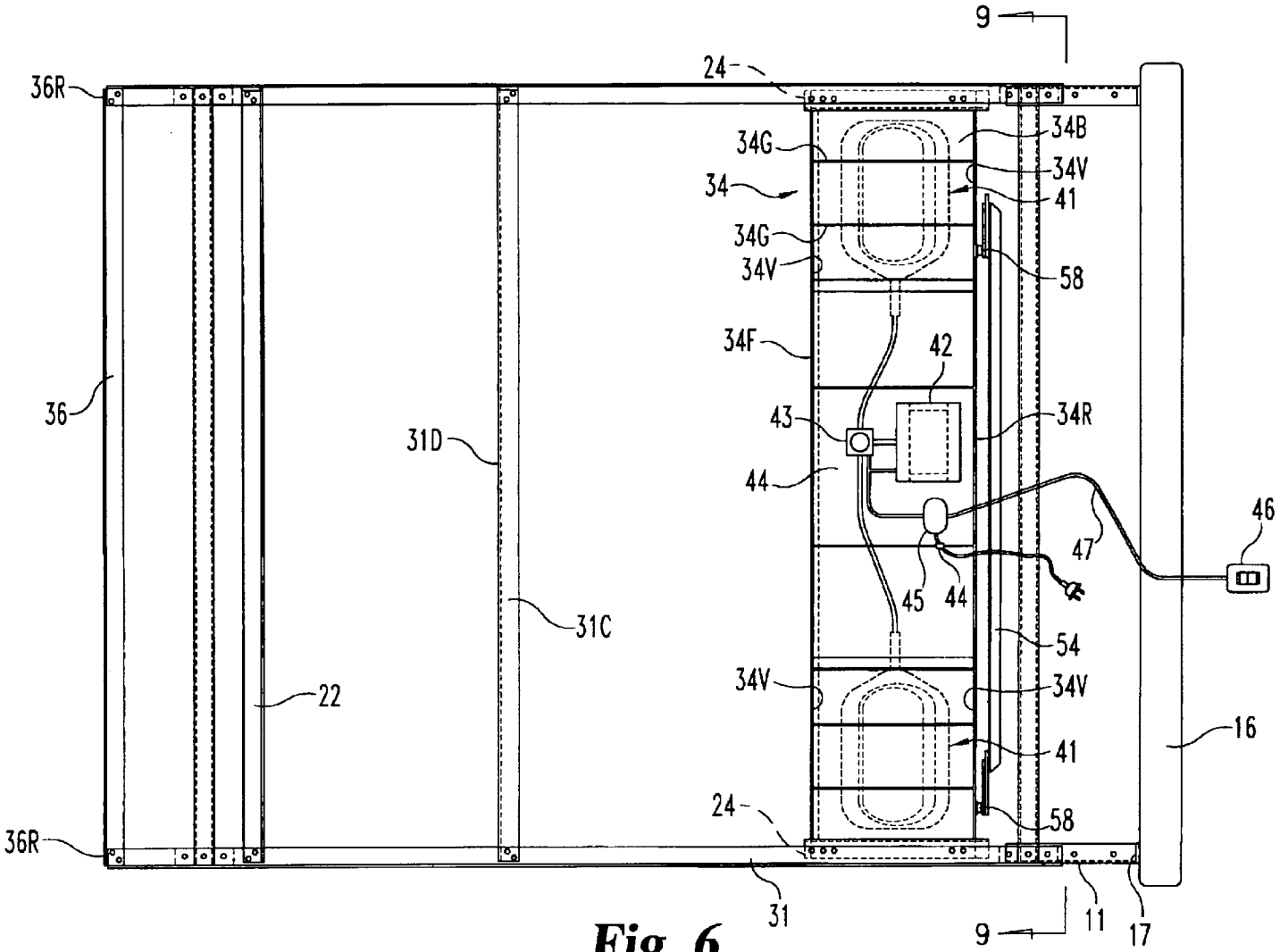
FIG. 6 is a top plan view thereof.

As shown in FIGS. 5 and 6, a bridge structure 23 of formed and welded metal construction is mounted and secured as by fasteners 24 to the in-turned flange 21F of each of the base frame side rails. Similarly, a bridge structure 34 of fabricated metal is secured to the bottom of the horizontal flange 31F of each of the side rails 31 of the tilting frame. Bridge structure 34 has front and rear cross members 34F and 34R, respectively. Bottom plates are fixed to members 34F and 34R adjacent each side of the structure. Buttressing ribs 34G are provided atop these plates and have their ends affixed to the vertical walls 34V of the members 34F and 34R. The same type of construction is provided on the underside of bridge unit 23. Therefore, the underside 34U of bridge 34 and the top side 23T of plates of 23 serve as bottom and top bearing surfaces for two inflatable bags 41. An air supply for these bags is provided by a compressor 42 through a reversible, three position solenoid valve assembly 43 in a power box 44 mounted to the bottom bridge 23. The power box is open at the top for easy access to the contents. It is hung and fixed on the front and rear cross members 23F and 23R, respectively, of the lower bridge 23.

Figure 11:
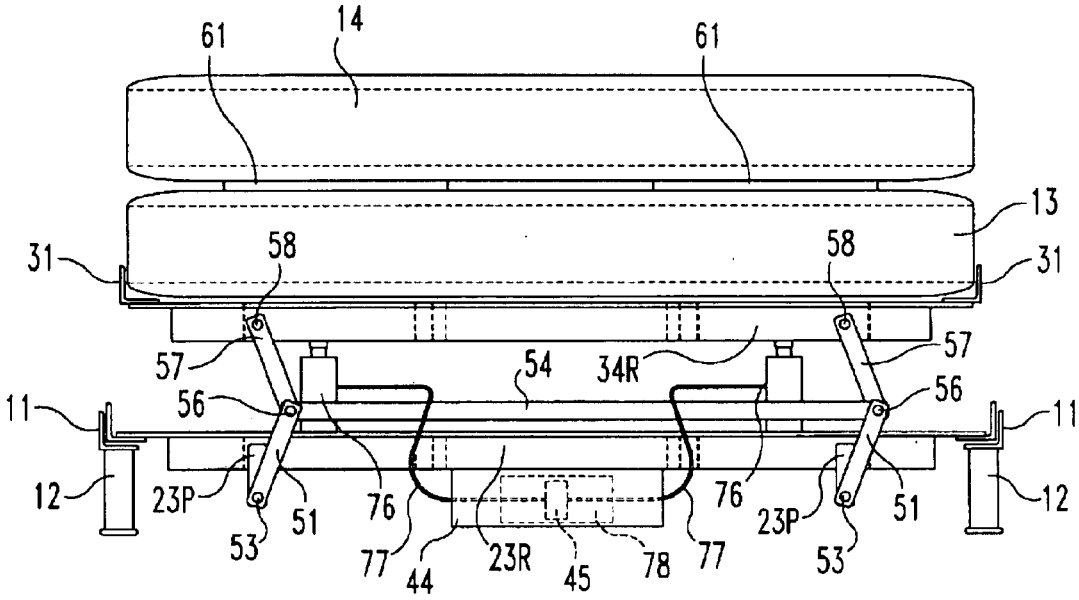
FIG. 11 is a view like FIG. 9 but showing a third embodiment employing electric actuators instead of the inflatable bags.

It should be understood that the present invention contemplates alternative forms of construction. For example, the compressor and air bag may be replaced with an electric actuator. An example is shown in FIG. 11 where electrical actuators 76 are located between the upper and lower bridges 34 and 23, respectively. In this case, the output from relay 45 is through electrical cables 77 to the electrical actuators. Some examples of useful electrical actuators may be solenoids, motor and screw drives, and motor and gear and rack drives.

Electrical power from a wall outlet (not shown) is continuously provided to the power box 44 and through an "on/off" switch 44S to the relay 45, and through a transformer, if desired, to the remote controller switch assembly 46. As shown in FIGS. 2 and 5, the switch assembly 46 is hand-held and is connected by cable 47 to the relay 45 in the control box. The load side of the relay is coupled to the compressor and solenoid for control of the compressor and the solenoid valve assembly. In one embodiment of the invention, the switch may have three positions, "up", "down", and "neutral". Accordingly, the solenoid valve is operable between the neutral, normally-closed condition, and one position supplying air from the compressor to the air bags, and the other position releasing pressure from the air bags to atmosphere. For the "up" operation, the signal from the remote switch triggers the relay 45 to turn the compressor on and shift the solenoid to open the air passageways from the compressor to the air bags. A limit switch (not shown) may be provided on the frames to return the solenoid valve to the neutral (closed) condition and turn off the compressor after the bed has been tilted to a maximum desired limit. An example would be when the one end of the mattress has been raised to eight inches above the level of the other end of the mattress. To reduce the inclination of the second frame, the "down" position of the switch will shift the solenoid valve to vent the bags through the valve to atmosphere. Suitable wiring for the desired functions can be provided according to the electrical codes of the jurisdictions in which the assembly will be marketed, and which is well within the skill of the art. While a wireless transmitter/receiver arrangement could be use for communication between the hand held switch and the power box, a hardwired coupling as through cable 47 may be used.

Figure 9:
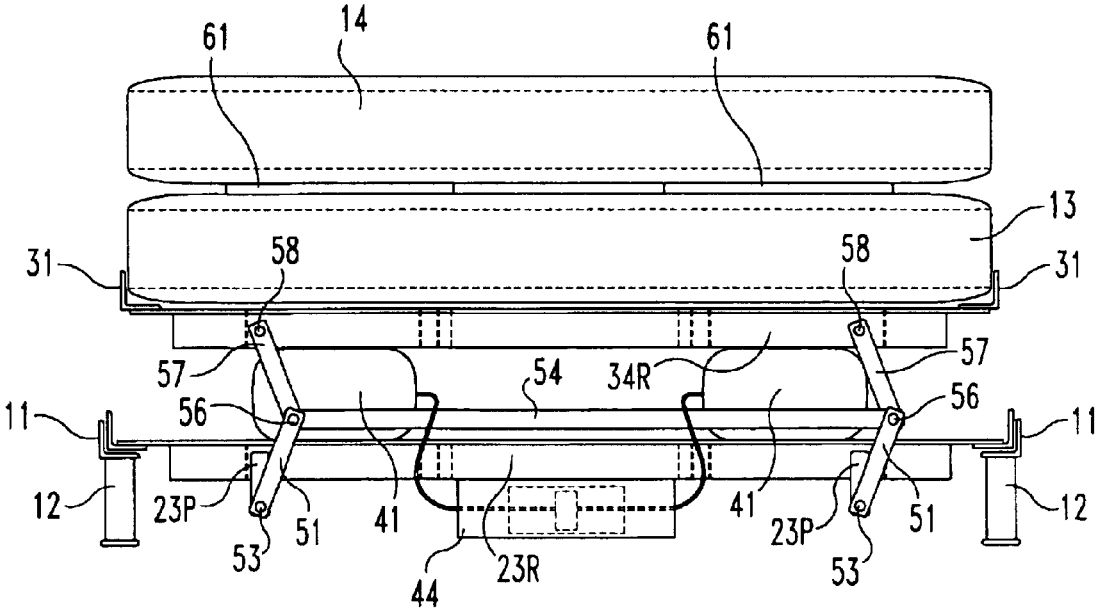
FIG. 9 is a section taken at line 9—9 in FIG. 6 and viewed in the direction of the arrows.

To provide uniformity of operation of the assembly, a parallelogram linkage is provided as best shown in FIG. 9. Posts 23P are fixed to and project downward from cross member 23R. Two parallel links 51 are pivotally connected to the posts 23P at 53. An intermediate "balance" link 54 is pivotally connected at the upper ends of links 51 by pins 56. Two additional parallel links 57 are pivotally connected to the balance link 54 at 56. The upper ends of these links 57 are pivotally connected at 58 to the bridge rear cross member 34R. In the drawings, the links are straight members, and have pivot points at their ends. But the links could be other shapes and have their pivot points located otherwise than at their ends. The important aspect is that each of the links provides a connection of some fixed length between points (pivot points) where it is pivotally connected to something. Therefore, as the air bags are inflated or deflated under control of the user, parallelism of the upper and lower bridges is maintained so that there is no lateral tilting of the bed, even if the weight of the person on the mattress is not evenly distributed across the mattress. Also, if there is only one air bag lifting the tilting frame, and located off center (as in FIG. 10) in contrast to two air bags lifting the tilting frame (as in FIG. 5), parallelism of the bridges is maintained. The only tilting is from the bag location end toward the pivoting end, to the degree desired by the occupant.

Figure 3:
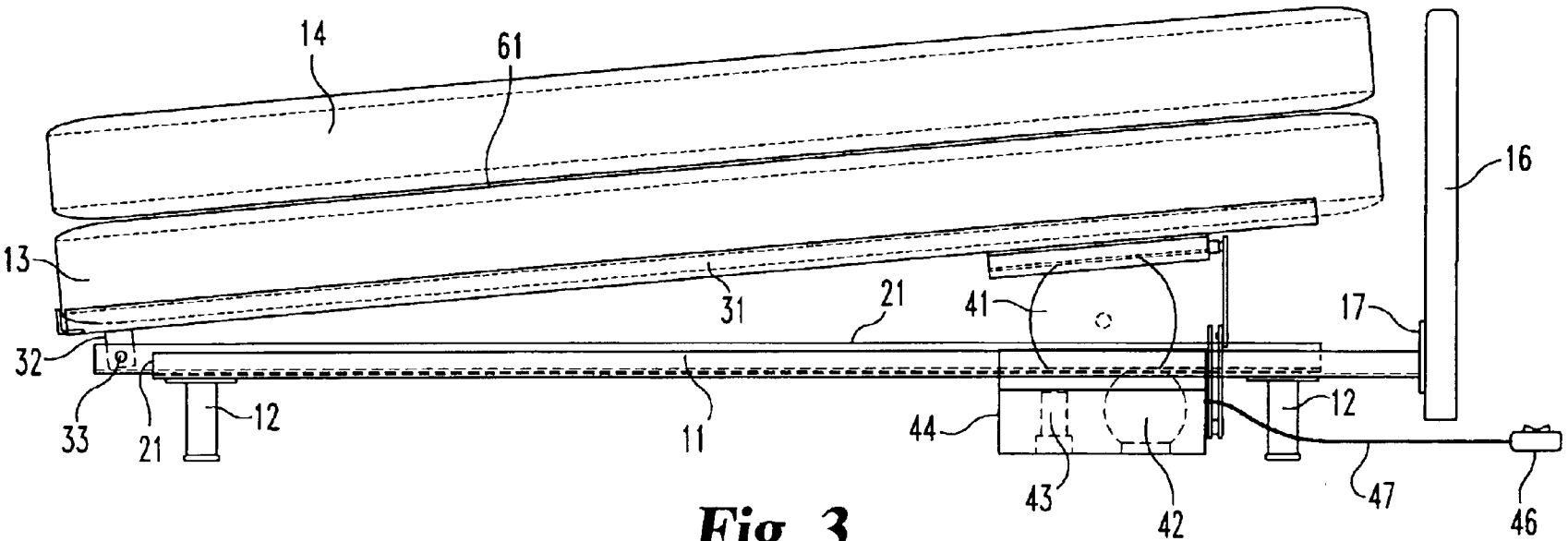
FIG. 3 is an elevational view thereof with the foundation and mattress set tilted.
Figure 4:
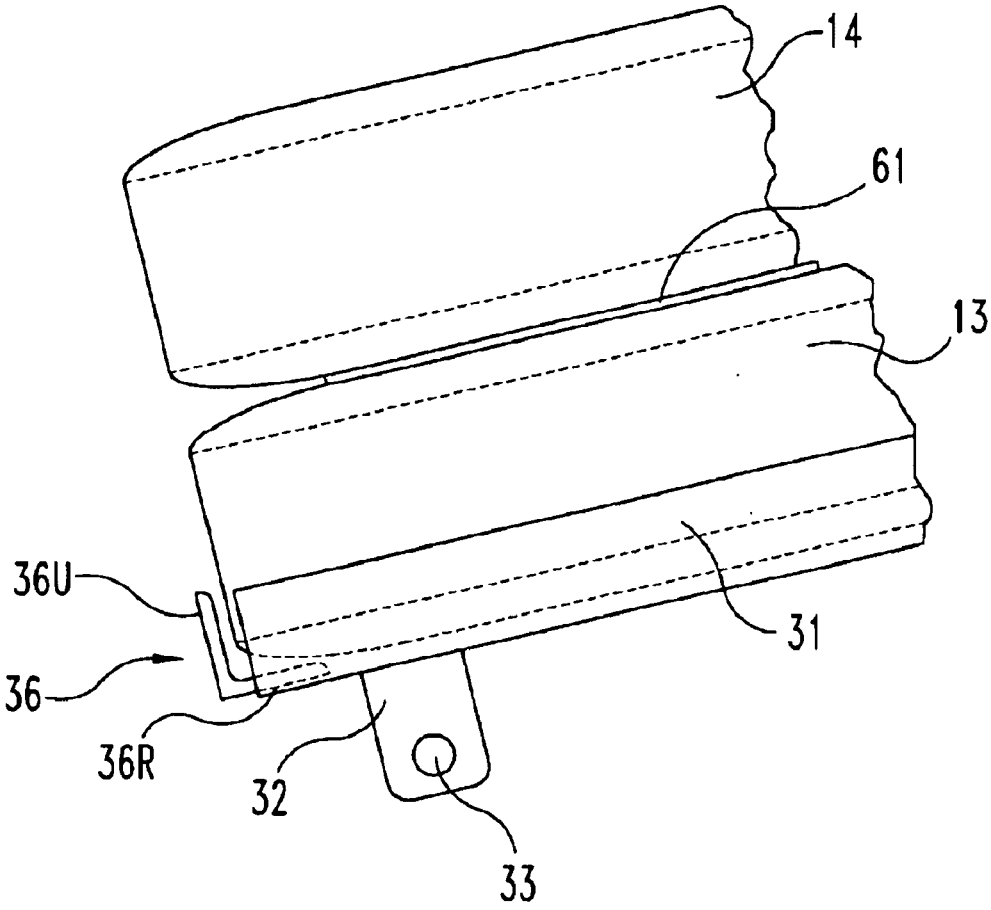
FIG. 4 is an enlarged fragmentary view illustrating the foundation and mattress retaining features.
Figure 7:
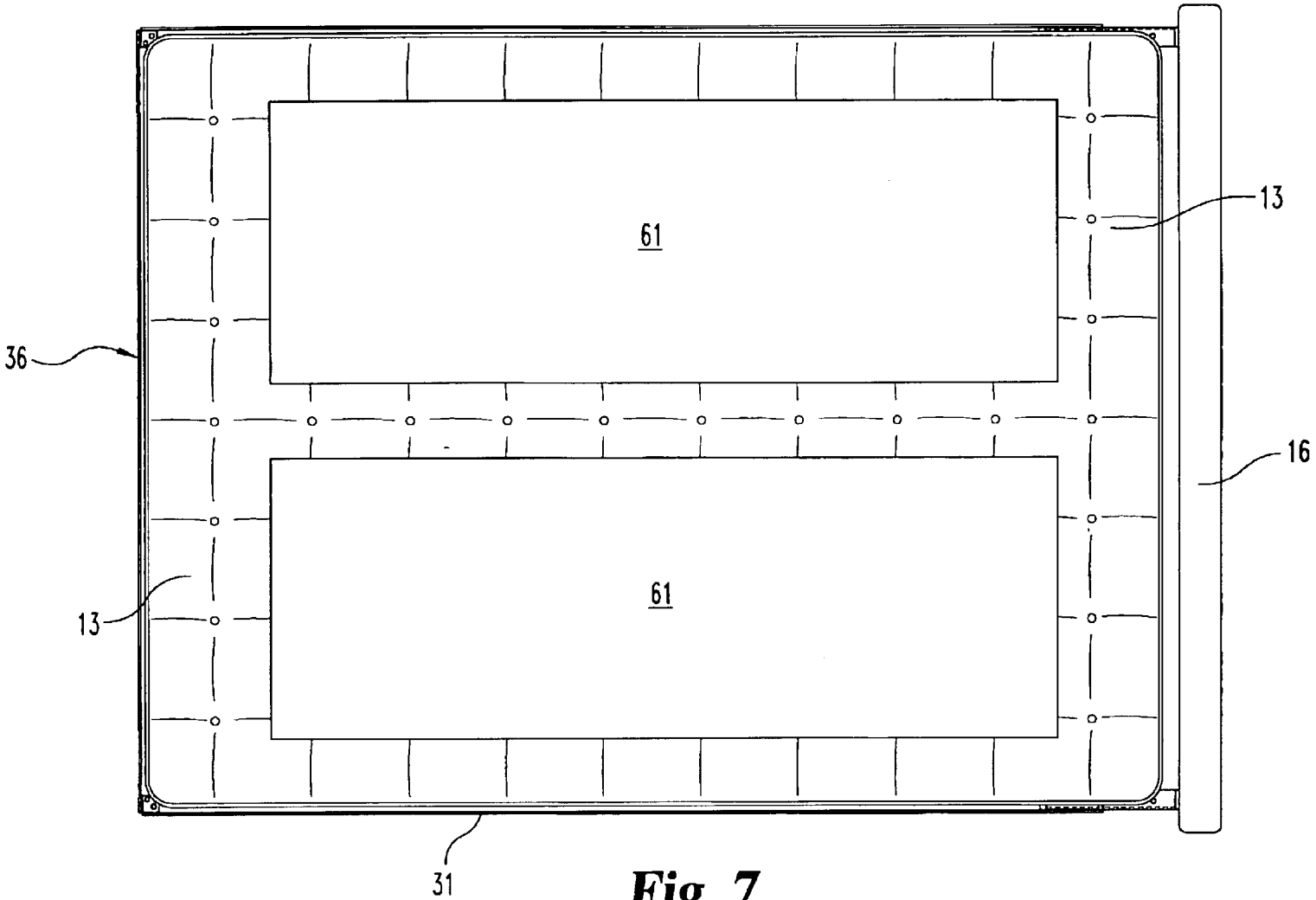
FIG. 7 is a plan view of the assembly with only the box foundation installed and showing the anti-slip feature.
Figure 8:
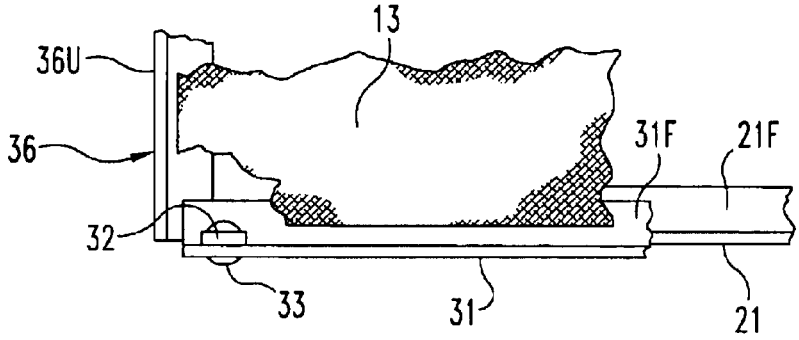
FIG. 8 is an enlarged fragmentary view of the corner thereof showing the relationship of the parts.

To avoid downward sliding of the foundation as the active end (where the bags are located) of the tilting frame is raised, a front cross member 36, which is an angle section of metal, is affixed at its ends as by fasteners 36R, for example, to the in-tuned bottom flanges 31F of the tilting frame rails 31. The up-turned flange 36U of the cross member 36 provides an abutment for the foundation 13 as best shown in FIG. 4. To prevent sliding of the mattress 14 downward on the foundation, a gripping liner or liners 61 (FIGS. 3, 4 and 7) are provided between the top of the foundation assembly and the bottom of the mattress. These may be of conventional material. A floor-to-rug non-slip type of mat is an example.

Figure 10:
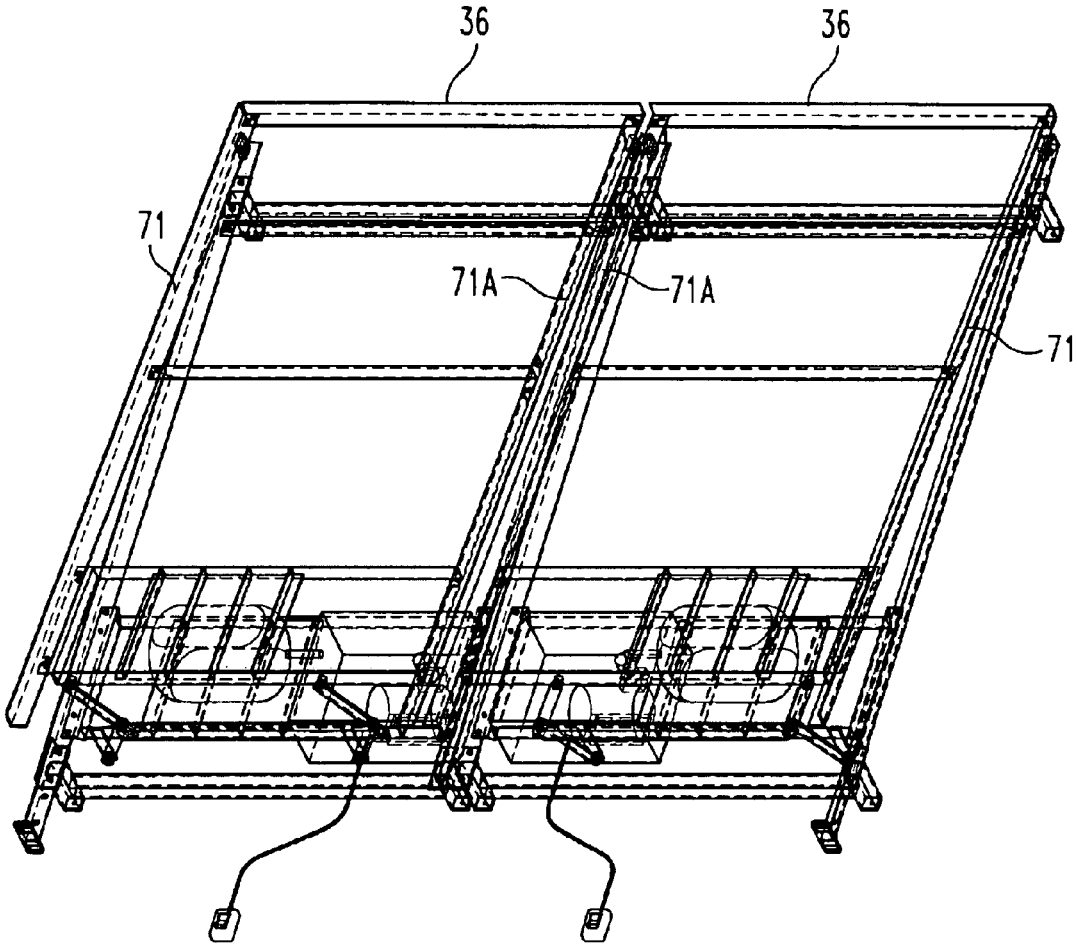
FIG. 10 is a rear perspective view of a second embodiment of the invention applied in a split king-size bed assembly.

At this point it should be noted that while the tilting frame assembly is shown mounted in a standard bed frame with the active end of the assembly at the head-end of the bed, it can just as well be mounted with the active end at the foot end of the bed, for those applications in which it is important that the occupant's feet be at a level above the head. Also, it should be understood that the tilting frame assembly is readily usable with any type of standard bed generally available to the public, regardless of whether it is a wood or metal frame bed as described above, or a bed using slats to support a foundation and mattress assembly. It should also be understood that the tilting frame assembly can be used independent of a conventional bed assembly. For that purpose, legs such as 12 can be mounted directly to the in-turned flanges 21F of the base frame 21 as shown at 12A in FIG. 5.

Where the tilting frame assembly is to be used with a conventional bed, it can be used with a standard size residential bed, a queen size, a king size, a split king, a double or twin. An example of the assembly for the split king is shown in FIG. 10. Most of the features are basically the same as in the FIGS. 1–9 embodiment. One illustrated variation exists in the respect that, while the outer rails 71 of the tilting frame have their outer flanges projecting upward as in the previously described embodiments, the inner and facing rails 71A have their flanges tilted downward. This is so the overall width will fit inside a conventional king frame and there is no interference with it resting securely within the overall framework. Where separate foundations and mattresses are to be used, each of the tilting frame assemblies has its own air bag and controller for it, as shown in FIG. 10. Of course, if the occupants of the bed will not need for both sides to be tiltable, some economy can be achieved by omitting the air bag and controller from one side. The type of foundation and mattress used can be conventional. Foam construction can be used. Also, although fabricated steel is the preferred material for the framework of the tilting frame assembly, other materials may be used.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow.

What is claimed:

1. A bed assembly comprising:

a first frame having parallel, horizontally spaced side rails having first and second ends and having a first bridge spanning space between said side rails;

a second frame having parallel, horizontally spaced side rails having first and second ends and having a second bridge spanning space between said side rails of said second frame, said second frame having pivotal mounting to said first frame adjacent said second ends of said side rails of said first and second frames for pivoting around a horizontal axis to incline said second frame downward from the first ends of said side rails of said second frame toward said second ends of said side rails of said second frame, said bridges being remote from said axis;

at least one inflatable bag being mounted on said first bridge and supporting said second bridge to raise said second bridge relative to said first bridge and establish said incline;

an air compressor supported on one of said bridges;

a control valve for providing communication between said compressor and said bag; and a control switch coupled to said valve and to said compressor to selectively inflate and deflate said bag; and wherein said first bridge has a first bag bearing member;

said second bridge has a second bag bearing member;

said bag has a bottom surface supported by said first bearing member and said bag has a top surface supporting said second bearing member when said second frame is inclined.

2. The bed assembly of claim 1 and wherein:

said bearing members are panels mounted to said bridges.

3. The bed assembly of claim 2 and wherein:

said second frame is rigid between said pivotal mounting and said bridges.

4. The bed assembly of claim 1 and wherein:

said control switch has an "up" position, a "neutral" position, and a "down" position, said neutral position being a normal rest position of the switch.

5. A bed assembly comprising:

a first frame having parallel, horizontally spaced side rails having first and second ends and having a first bridge spanning space between said side rails;

a second frame having parallel, horizontally spaced side rails having first and second ends and having a second bridge spanning space between said side rails of said second frame, said second frame having pivotal mounting to said first frame adjacent said second ends of said side rails of said first and second frames for pivoting around a horizontal axis to incline said second frame downward from the first ends of said side rails of said second frame toward said second ends of said side rails of said second frame, said bridges being remote from said axis;

at least one inflatable bag being mounted on said first bridge and supporting said second bridge to raise said second bridge relative to said first bridge and establish said incline;

an air compressor supported on one of said bridges;

a control valve for providing communication between said compressor and said bag;

a control switch coupled to said valve and to said compressor to selectively inflate and deflate said bag; and a power box mounted to said first bridge and extending downward from said first bridge, and containing said air compressor and said control valve.

6. A bed assembly comprising:

a first frame having parallel, horizontally spaced side rails having first and second ends and having a first bridge spanning space between said side rails;

a second frame having parallel, horizontally spaced side rails having first and second ends and having a second bridge spanning space between said side rails of said second frame, said second frame having pivotal mounting to said first frame adjacent said second ends of said side rails of said first and second frames for pivoting around a horizontal axis to incline said second frame downward from the first ends of said side rails of said second frame toward said second ends of said side rails of said second frame, said bridges being remote from said axis;

at least one inflatable bag being mounted on said first bridge and supporting said second bridge to raise said second bridge relative to said first bridge and establish said incline;

an air compressor supported on one of said bridges;

a control valve for providing communication between said compressor and said bag;

a control switch coupled to said valve and to said compressor to selectively inflate and deflate said bag;

a mattress having a first end and a second end and supported by said second frame whereby said mattress is inclined downward from said first end of said mattress toward said second end of said mattress when said second frame is inclined downward;

a foundation assembly mounted on said second frame under said mattress and supporting said mattress; and a gripping liner between said mattress and said foundation assembly and contacting said mattress and said foundation assembly to inhibit slippage of said mattress relative to said foundation assembly.

7. The bed assembly of claim 6 and wherein:

said second frame has a stop at its second end for engagement by said foundation assembly when said second frame is inclined, to prevent said foundation assembly from sliding downward on said second frame when said second frame is inclined.

8. A bed assembly comprising:

a first frame having parallel sides and a first end and a second end;

a second frame above said first frame and having parallel sides and having a first end and a second end, said second frame having pivotal mounting to said first frame adjacent said second ends of said first and second frames for pivoting around a horizontal axis extending through said pivotal mounting, said second frame having co-planar support surfaces for receiving a foundation assembly and supporting said foundation assembly in a horizontal attitude when said second frame is disposed in an original rest position;

at least one inflatable bag mounted between said first and second frames remote from said second end of said first frame and operable when being inflated to pivot said second frame around said horizontal axis to raise said first end of said second frame relative to said first end of said first frame and thereby incline said second frame downward from said first end of said second frame toward said second end of said second frame; and linkage coupled to said frames adjacent said first ends of said frames and arranged to maintain said support surfaces co-planar during the said raising of said first end of said second frame; and wherein said linkage comprises:

a first pair of links, each link having lower pivot centers pivotally connected to said first frame at locations horizontally-spaced from said sides of said first frame and remote from said second end of said first frame, the lower pivot centers of said links being horizontally spaced from each other, each of said links having upper pivot centers;

an intermediate link pivotally connected to said upper pivot centers of said links of said first pair;

a second pair of links, each link of said second pair having lower pivot centers pivotally connected to said intermediate link at horizontally-spaced locations on said intermediate link, each of said links of said second pair having upper pivot centers pivotally connected to said second frame at locations horizontally-spaced from opposite sides of said second frame and remote from said second end of said second frame;

a line between pivot centers of each link of said first pair being parallel to a line between pivot centers of the other link of said first pair; and a line between pivot centers of each link of said second pair being parallel to a line between pivot centers of the other link of said second pair.

9. The bed assembly of claim 8 and wherein:

the distance between the pivot centers of each of said links of said first pair being equal to the distance between the pivot centers of each link of said links of said second pair.

10. The bed assembly of claim 8 and wherein:

said lines of said first pair intersect lines of said second pair at angles less than 180 degrees at said pivot centers at said intermediate link.

11. A bed assembly comprising:

a first frame having parallel sides and a first end and a second end;

a second frame above said first frame and having parallel sides and having a first end and a second end, said second frame having pivotal mounting to said first frame adjacent said second ends of said first and second frames for pivoting around a horizontal axis extending through said pivotal mounting, said second frame having co-planar support surfaces for receiving a foundation assembly and supporting said foundation assembly in a horizontal attitude when said second frame is disposed in an original rest position;

at least one inflatable bag mounted between said first and second frames remote from said second end of said first frame and operable when being inflated to pivot said second frame around said horizontal axis to raise said first end of said second frame relative to said first end of said first frame and thereby incline said second frame downward from said first end of said second frame toward said second end of said second frame;

linkage coupled to said frames adjacent said first ends of said frames and arranged to maintain said support surfaces co-planar during the said raising of said first end of said second frame; and a third frame having parallel sides and a first end and a second end;

a first foundation assembly mounted on said second frame; and a first mattress mounted on said foundation assembly.

12. The bed assembly of claim 11 and further comprising:

a second foundation assembly supported on said third frame; and a second mattress mounted on said second foundation assembly.

13. The bed assembly of claim 12 and further comprising:

a bed frame having legs for supporting said bed frame above a floor;

said first and third frames being received on and supported by said bed frame above said floor.

14. The bed assembly of claim 11 and further comprising:

a fourth frame above said third frame and having parallel sides and having a first end and a second end, said fourth frame having a pivotal mounting to said third frame adjacent said second ends of said third and fourth frames for pivoting around a horizontal axis extending through said pivotal mounting of said third frame and said fourth frame, said fourth frame having co-planar support surfaces for receiving a foundation assembly and supporting said foundation assembly in a horizontal attitude when said third frame is disposed in an original rest position; and at least one inflatable bag mounted between said third and fourth frames remote from said second end of said third frame and operable when being inflated to pivot said fourth frame around said second horizontal axis to raise said first end of said fourth frame relative to said first end of said third frame, and thereby incline said fourth frame downward from said first end of said fourth frame toward said second end of said fourth frame; and a first remote controller coupled to said bag mounted between said first and second frames to inflate and deflate said first inflatable bag; and a second remote controller coupled to said second bag and operable to selectively inflate and deflate said second bag independently from said first bag.

15. A bed assembly comprising:

a first frame having parallel, horizontally spaced side rails having first and second ends and having a first crossmember spanning space between said side rails;

a second frame having parallel, horizontally spaced side rails having first and second ends and having a second crossmember spanning space between said side rails of said second frame, said second frame having pivotal mounting to said first frame adjacent said second ends of said side rails of said first and second frames for pivoting around a horizontal axis to incline said second frame downward from the first ends of said side rails of said second frame toward said second ends of said side rails of said second frame, said crossmembers being remote from said axis;

at least one lifting device mounted on one of said frames to raise said second frame relative to said first frame and establish said incline;

a control switch coupled to said lifting device to selectively increase and decrease said incline;

a mattress having a first end and a second end and supported by said second frame whereby said mattress is inclined downward from said first end of said mattress toward said second end of said mattress when said second frame is inclined downward;

a foundation assembly mounted on said second frame under said mattress and supporting said mattress; and a gripping liner between said mattress and said foundation assembly and contacting said mattress and said foundation assembly to inhibit slippage of said mattress relative to said foundation assembly.

16. The bed assembly of claim 15 and wherein:

said second frame has a stop at its second end for engagement by said foundation assembly when said second frame is inclined, to prevent said foundation assembly from sliding downward on said second frame when said second frame is inclined.

* * * * *